US009831547B2

(12) United States Patent
Powell et al.

(10) Patent No.: US 9,831,547 B2
(45) Date of Patent: Nov. 28, 2017

(54) METHODS AND DEVICES FOR CONFIGURING ANTENNA ARRAYS

(71) Applicant: Radio Frequency Systems, Inc., Meriden, CT (US)

(72) Inventors: Charles M. Powell, Vernon, CT (US); Raja Reddy Katipally, Cheshire, CT (US)

(73) Assignee: Alcatel-Lucent Shanghai Bell Co., Ltd., Shanghai (CN)

( * ) Notice: Subject to any disclaimer, the term of this patent is extended or adjusted under 35 U.S.C. 154(b) by 627 days.

(21) Appl. No.: 14/455,171

(22) Filed: Aug. 8, 2014

(65) Prior Publication Data

US 2017/0104267 A1 Apr. 13, 2017

(51) Int. Cl.

| | |
|---|---|
| ***H01Q 3/04*** | (2006.01) |
| ***H01Q 1/24*** | (2006.01) |
| ***H01Q 21/06*** | (2006.01) |
| ***H01Q 21/08*** | (2006.01) |

(52) U.S. Cl.

CPC ..... *H01Q 3/04* (2013.01); *H01Q 1/246* (2013.01); *H01Q 21/061* (2013.01); *H01Q 21/065* (2013.01); *H01Q 21/08* (2013.01)

(58) Field of Classification Search

CPC ..... H01Q 3/04; H01Q 21/061; H01Q 21/065

See application file for complete search history.

(56) References Cited

U.S. PATENT DOCUMENTS

| | | | | |
|---|---|---|---|---|
| 7,403,172 | B2 * | 7/2008 | Cheng | H01Q 9/0407 343/700 MS |
| 7,903,038 | B2 * | 3/2011 | Tietjen | H01Q 1/1235 343/711 |
| 2015/0222013 | A1 * | 8/2015 | Choi | H01Q 3/04 343/879 |

OTHER PUBLICATIONS

Gogo, Inc., "WCS for Ground to Air Use", presented Jan. 11, 2012.

* cited by examiner

*Primary Examiner* — Hoang Nguyen

(74) *Attorney, Agent, or Firm* — The Capitol Patent & Trademark Law Firm, PLLC

(57) ABSTRACT

An antenna array may include a plurality of co-planar antenna elements forming a sub-array, and at least one non-planar antenna element configured to tilt relative to a planar orientation of the sub-array to provide an air-to-ground service.

18 Claims, 5 Drawing Sheets

METHODS AND DEVICES FOR CONFIGURING ANTENNA ARRAYS

INTRODUCTION

It is desirable to provide increased wireless communication coverage between aircraft or drones and existing ground-based base station towers using air-to-ground (ATG) wireless communications systems. To do so, several technical issues should be addressed. For example, the radiation pattern of an antenna array that is mounted on a tower used by a conventional ground-based, wireless (e.g., cellular) base station includes large "null" areas directly above and below the array (areas where little or no power is radiated at radio frequencies (RF)). Referring to FIGS. 1*a* and 1B there are shown an antenna array 100, and its emission pattern 101, respectively. The emission pattern 101 includes a prominent central lobe 102, smaller side lobes 103 and nulls 104*a,b*. Though such a pattern 101 is acceptable for transmissions with ground-based devices it is unacceptable for ATG services.

For example, such a pattern typically includes a "dead zone" resulting from null 104*b* directly below the antenna array. By way of example, an antenna array supported on a 200 foot tower may create a dead zone of 145 feet in width (assuming a 20-degree null). Normally, this width is not a problem for ground-based wireless communications because the area directly below or directly proximate to the tower is typically not a region where ground-based users are expected to be located or expected to need a wireless connection. Similarly, ground-based users are not typically expected to need a wireless connection to the tower in the space above the tower. However, when an ATG service is desired, and an aircraft (or drone) altitudes are considered, the same 20-degree null may translate into a "multiple miles-wide" dead zone.

Mathematically, the width of the dead zone may be determined by the relationship:

$$W=D*\mathrm{TAN}(N^{\circ})*2$$

where W is the width of the dead zone, D is the distance of a user above the antenna, and N° is the angular width of the null. Using this relationship, at an exemplary aircraft altitude of 30,000 feet, a null width equates to a 4 mile wide dead zone. Accordingly, such a dead zone around every tower of a network presents a problem when ATG service is desirable using the network. Further, additional nulls 105 between side lobes 103 create additional dead zones that should be addressed.

One existing solution addresses nulls between side lobes, but not nulls directly above a tower. This solution changes the phase of an antenna array so that larger side lobes, that are normally directed towards the ground, are instead inverted or "flipped" and directed upwards to fill in nulls between the side lobes. Antenna elements in the array are fed unequally so that more power is fed to either the top or the bottom elements of the antenna rather than a normal symmetrical power distribution. This creates what is known as a cosecant-squared distribution 1101, as shown in FIG. 1C. However, while the nulls between the side lobes may be filled, the nulls 1104*a,b* directly above and below the antenna remain.

A further variation to the cosecant-squared distribution arrangement is to mechanically tilt the antenna array upwards. However, in order to maintain a maximum RF transmission range directed toward the horizon for ground-based services, it is necessary to electrically steer the beam downward by an amount corresponding to the upward tilt of the antenna. FIG. 2A depicts a linear antenna array 200 that is tilted upward about 20 degrees, while FIG. 2B depicts the distribution 201 resulting from a corresponding downward steering of a radiated beam. While the null directly above the antenna is somewhat filled in, it remains suppressed by about 22 dB relative to the central lobe, which is considered insufficient, and the lower null 204 remains. Preferably, the upper null should be filled to about 15 dB, and the upper side lobes to 5-10 dB, down from the central lobe, and it is further desirable to suppress lower side lobes. Such lower side lobes may sometimes result in potential disruption of satellite radio reception in cars because certain ATG frequencies are adjacent to frequencies used by satellite radio systems.

SUMMARY

Embodiments of the present invention are directed at solving the technical issues described above.

One embodiment of an antenna array comprises a plurality of co-planar antenna elements arranged in a planar sub-array, and at least one non-planar antenna element that may be configured to tilt relative to a planar orientation of the sub-array (e.g., upwards). Further, the at least one non-planar antenna element may be configured to tilt upwards at an angle of 30 degrees.

The elements forming the sub-array may be configured in a substantially vertical planar orientation to direct a radiated beam toward a horizon. In one embodiment the sub-array may comprise eight co-planar antenna elements, though more or less elements may be used.

In addition to the antenna elements, the array may comprise a power control section operable to supply a substantially same, first RF signal having a first power level to the sub-array, and supply a second RF signal having a second power level to the at least one non-planar antenna element. In one embodiment, the second power level may be six times more than the first power level.

Still further, the array may comprise a tilt control system operable to tilt the non-planar antenna element (e.g., upwards), or tilt the antenna array upwards, and an electrical steering control system operable to electrically steer a main beam downwards by an amount corresponding to the upwards tilt of the array. For example, the tilt control system may be operable to tilt the array upwards less than 5 degrees, while the electrical steering control system may be operable to electrically steer the main beam over a range of 0-20 degrees, or, alternatively, over a range of 5-20 degrees.

In addition to the apparatuses discussed above, the present invention also provides corresponding and exemplary methods for configuring an antenna array. One such method may comprise arranging a plurality of co-planar antenna elements in a planar sub-array, and configuring at least one non-planar antenna element to tilt upwards relative to a planar orientation of the sub-array, where the at least one non-planar antenna element is tilted upwards at an angle of 30 degrees. In more detail, the co-planar elements of the sub-array may be arranged in a substantially vertical planar orientation to direct a radiated beam toward a horizon.

Similar to the apparatuses discussed above, the number of co-planar antenna elements that are arranged to form the sub-array may be eight, or more or less than eight.

The method may further comprise one or more of the following: (a) supplying a substantially same, first RF signal having a first power level to the sub-array, and supplying a second RF signal having a second power level to the at least one non-planar antenna element; (b) tilting the non-planar antenna element; (c) tilting the antenna array upwards; and (d) electrically steering a main beam downwards by an amount corresponding to the upwards tilt of the array.

In one embodiment the supplied, second power level is six times more than the supplied, first power level.

Yet further, the method may tilt the array upwards less than 5 degrees, and electrically steer a main beam over a range of 0-20 degrees, or over a range of 5-20 degrees.

These and other features, aspects, and advantages of the present invention will become better understood with regard to the following description, appended claims, and accompanying drawings.

EXEMPLARY EMBODIMENTS & DETAILED DESCRIPTION

Figure 1A:
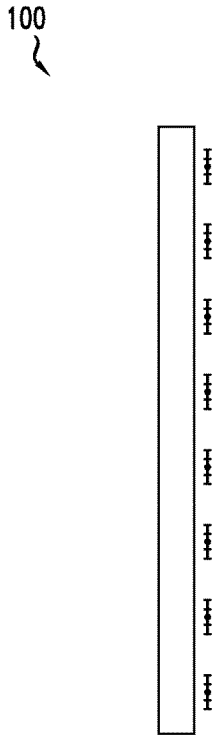
FIG. 1A is diagrammatic side view of a conventional antenna array.
Figure 1B:
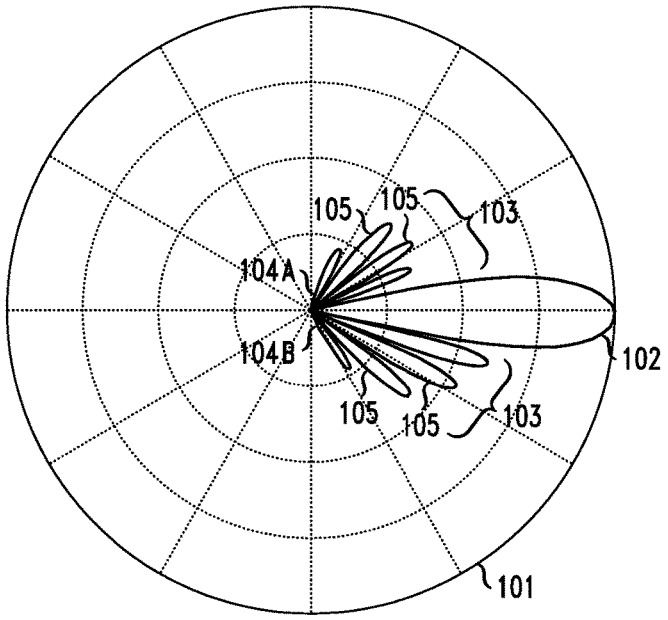
FIG. 1B shows a radiation pattern of a conventional antenna array of FIG. 1A.
Figure 1C:
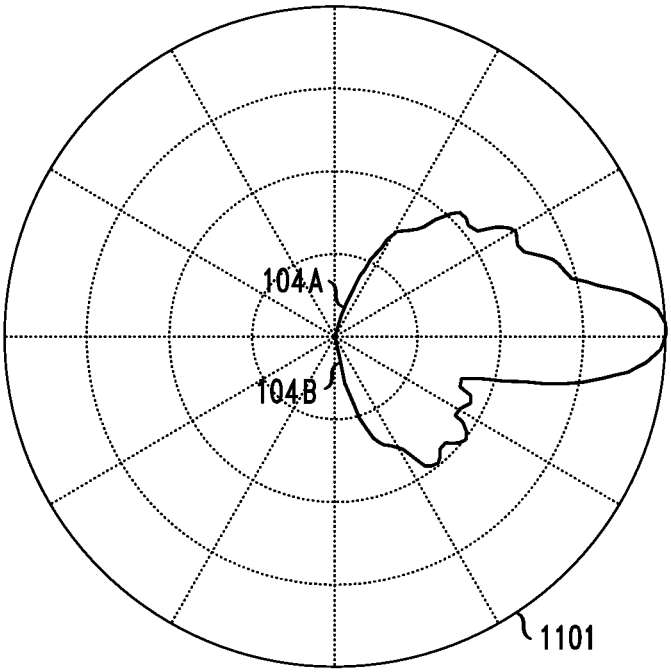
FIG. 1C shows a radiation pattern of a conventional antenna array of FIG. 1A having a cosecant-squared distribution.
Figure 2A:
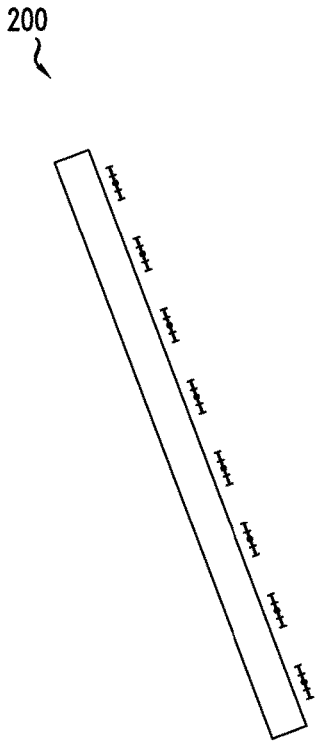
FIG. 2A is diagrammatic side view of a conventional antenna array tilted upward.
Figure 2B:
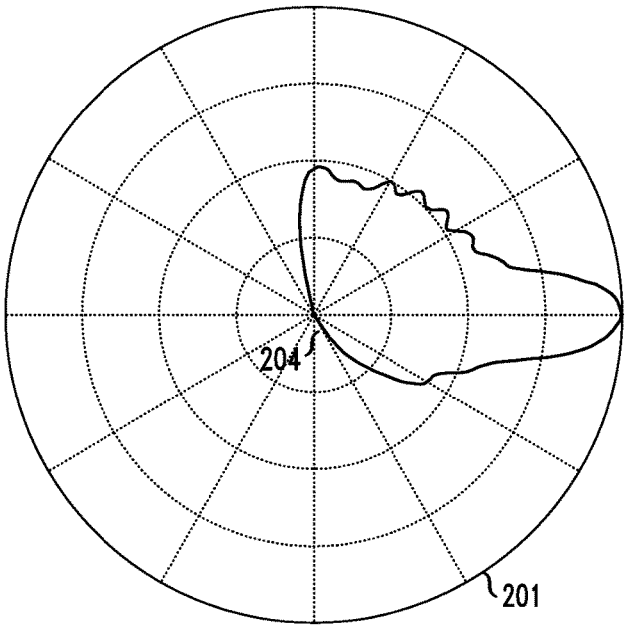
FIG. 2B shows a radiation pattern of a conventional antenna array of FIG. 2A having a cosecant-squared distribution.

Exemplary embodiments for configuring antenna arrays are described herein and are shown by way of example in the drawings. Throughout the following description and drawings, like reference numbers/characters refer to like elements.

It should be understood that, although specific exemplary embodiments are discussed herein there is no intent to limit the scope of present invention to such embodiments. To the contrary, it should be understood that the exemplary embodiments discussed herein are for illustrative purposes, and that modified and alternative embodiments may be implemented without departing from the scope of the present invention.

It should also be noted that one or more exemplary embodiments may be described as a process or method. Although a process/method may be described as sequential, it should be understood that such a process/method may be performed in parallel, concurrently or simultaneously. In addition, the order of each step within a process/method may be re-arranged. A process/method may be terminated when completed, and may also include additional steps not included in the description of the process/method.

As used herein, the term "and/or" includes any and all combinations of one or more of the associated listed items. As used herein, the singular forms "a," "an" and "the" are intended to include the plural form, unless the context indicates otherwise.

As used herein, the term "embodiment" refers to an exemplary embodiment of the present invention.

As used herein the phrase "co-planar" describes antenna radiating elements ("antenna elements" for short) that are substantially oriented parallel to the same plane, while "non-planar" describes an antenna element or elements that is/are not so oriented (e.g., at least one element is oriented in a different plane than other elements).

In accordance with one embodiment, an antenna array for ATG service may comprise a plurality of co-planar antenna elements and at least one non-planar antenna element, where the non-planar element may be configured to tilt upwards relative to a plane of the sub-array 310. Each of the antenna elements may be dipole, patch or other antenna radiating elements, for example.

Figure 3A:
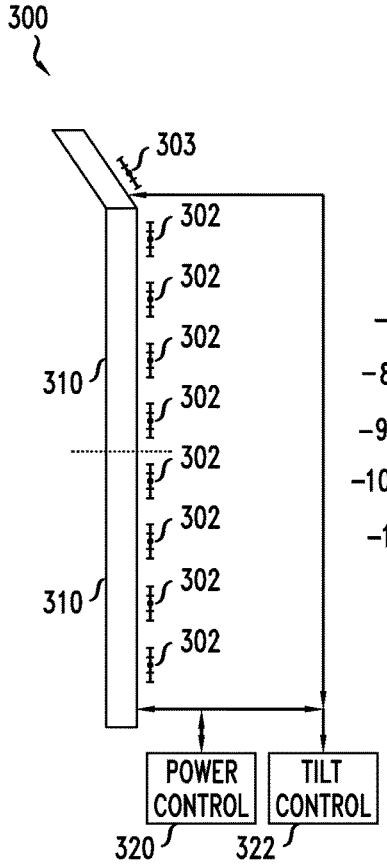
FIG. 3A is a simplified diagrammatic side view of an antenna array according an embodiment of the present invention.

Referring to FIG. 3A, an exemplary antenna array 300 is shown according to an embodiment of the invention. As depicted, the array 300 includes a plurality of co-planar antenna elements 302 arranged in a planar sub-array 310, and a single upwards directed non-planar antenna element 303 disposed, for example, at the top of the array 300. In one embodiment, the non-planar antenna element 303 may be configured to tilt upwards relative to the physical, planar orientation (i.e., plane) of the sub-array 310, or more generally, relative to a central lobe of the overall array 300. When so tilted, a radiating element of the antenna element 303 is not aligned in the same plane as the radiating elements of antenna elements 302 in the sub-array 310.

The co-planar antenna elements 302 may be configured in a substantially, vertical planar orientation and aligned with respect to one another to form the sub-array 310. In one embodiment, the elements 302 may be operated and configured to create a narrow main beam that is directed to radiate towards the horizon. The embodiment shown in FIG. 3A includes eight elements 302 in the sub-array 310, although it should be understood that the sub-array 310 may comprise more or less elements 302. The number of co-planar elements 302 may be varied to create a narrow or wide main beam. For example, the lesser the number of elements 302 the wider the beam, while the greater the number of elements 302 the narrower the beam.

In the embodiment shown, the antenna 300 includes a single non-planar, upward directed antenna element 303, although it should be understood that additional antenna elements 303 may be provided. The at least one non-planar antenna element 303 may be tilted upward relative to the physical, planar orientation (i.e., plane) of the sub-array 310.

The amount of tilting of the antenna element 303 relative to the sub-array 310 determines how much of a corresponding top null is filled in. For example, when the antenna element 303 is tilted 90 degrees (that is, pointed straight up), a corresponding top null may be filled in substantially completely. However, in so doing a large amount of power emitted from the antennas may be directed into the back half of the antenna pattern, negatively impacting the antenna array's front-to-back ratio (f/b). Conversely, reducing the tilt to 0 degrees may minimize the impact on f/b, but substantially eliminate filling of the top null.

The inventors have found that a tilt within a range of 10 to 70 degrees provides some filling of the top lobe without introducing an unacceptable degradation of f/b. Yet further, the inventors have found that when the non-planar antenna element 303 is configured to tilt upwards at an angle of 30 degrees, such a configuration provides an increased filling of the top null, while substantially reducing the negative impacts on f/b, among other factors.

In one embodiment, the array 300 may comprise a tilt control system 322 that is operable to control at least the tilt angle of the element 303. The tilt control system 322 may comprise a number of tilt control means. For example, the system 322 may comprise an adjustable arm (not shown) that may be connected to element 303, and operable to be adjusted (e.g., up or down) in order to change the physical angle of the element 303 with respect to its mounting mechanism (e.g., pipe)(not shown). The arm may be adjusted manually, or by an electrical controller that is a part of the system 322, for example, and controllably connected to the element and arm. The system 322, or one of its components, may be located nearby the element 303 or mounted at the base of the tower to which the element 303 is mounted. In an alternative embodiment, a weather shield, such as a radome, may enclose the array 300 as well as element 303.

The level of the upper side lobes, as well as the filling of the top null, may be controlled by the power that is supplied to the antenna element 303. In one embodiment, a power control section 320 that is made a part of the base station or array, for example, may be connected to the array 300 and operable to control the power being supplied to the elements 302, 303. In one embodiment, the section 320 may supply the substantially same, first RF signal having a first power level to elements 302 and supply a second RF signal having a second power level to element 303. In an embodiment of the invention the second power level may be a factor that is one to ten times more than the first power level.

Figure 3B:
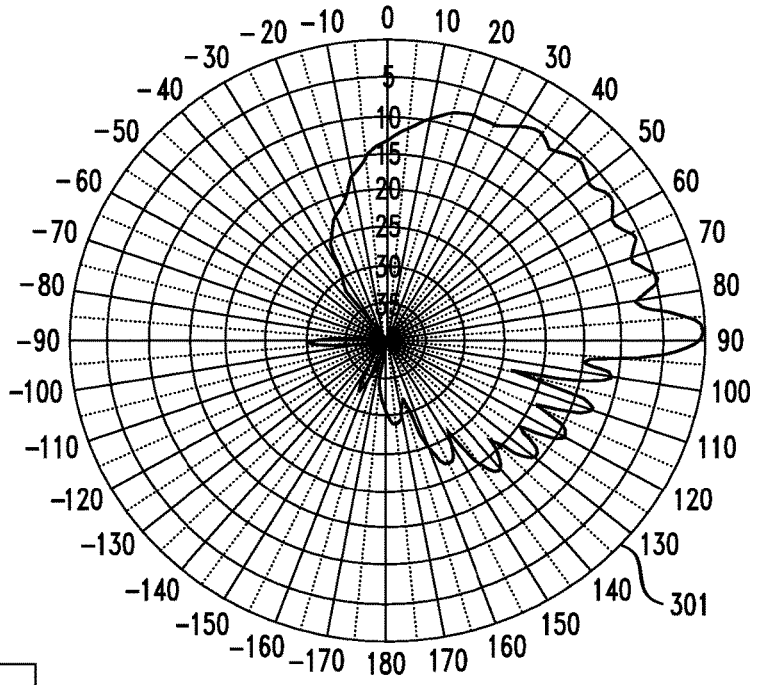
FIG. 3B shows a radiation pattern of the antenna array in FIG. 3A according to an embodiment of the present invention.

Referring to FIG. 3B, a power distribution plot 301 of an antenna array, such as array 300 in FIG. 3A, is shown. As shown, the plot 301 depicts an exemplary instance when the antenna element 303 is supplied with 6 times as much power as elements 302. That is, the antenna element 303 may receive 6 times as much power as the other eight elements 302 combined. While this may be an unequal power distribution, the resulting power distribution pattern provides high side lobes (5-10 dB), filling of the top null at 15 dB and relatively reduced lower side lobes. It should be noted that the amount of null fill, as well as the high side lobes, constitutes somewhat of a trade-off with respect to the overall gain of the antenna array. For example, in one embodiment approximately 5 dB less gain than a similarly sized array may result. The loss of overall gain can be mitigated by a reduction in power to the antenna element 303, though this may result in a reduction in the upper side lobes and top null fill.

Figure 3C:
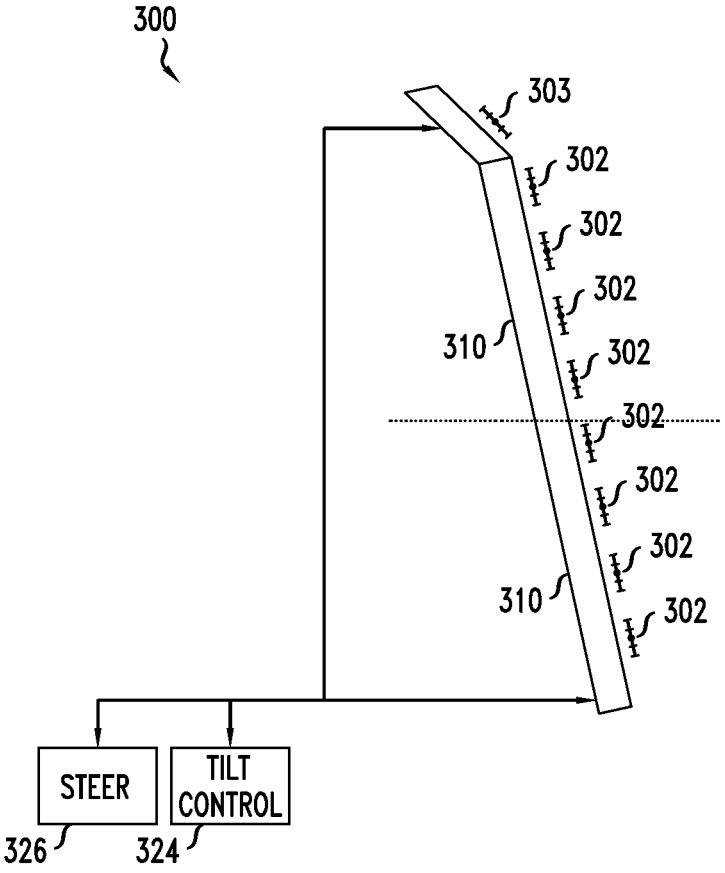
FIG. 3C is a simplified diagrammatic side view of an alternative antenna array according another embodiment of the present invention.

The antenna array 300 may be further adapted to provide improved ATG communications by tilting the entire antenna array 300, including the already tilted element 303 (upwards) with respect to the horizon as shown in the simplified drawing of FIG. 3C, and electrically steering the main beam a corresponding opposite amount. In this embodiment the antenna array 300 may further comprise a tilt control system 324 that is operable to mechanically tilt the array 300 in a first direction (e.g., upward) to direct a radiated main beam above a horizon, for example, by tilting the array less than 5 degrees, and an electrical steering control system 326 that is operable to electrically steer the main beam in a second direction (e.g., downward) opposite the first direction by an amount corresponding to the tilt of the array 300 (e.g., by less than 5 degrees). The electrical steering control system 326 may comprise, for example, a variable phase shifting network that is connected to each element 302, 303, and that is operable to vary the phase between dipoles of the antenna elements.

In alternative embodiments the tilt control system 324 may be operable to tilt the array 300 over a range of 0 to 20 degrees or 5 to 20 degrees. Similarly, the electrical steering control system 326 may be operable to correspondingly steer the main beam over a range of 0-20 degrees or a range of 5-20 degrees in an opposite direction that the array is tilted. In yet a further embodiment, the main beam and array 300 may be tilted/steered using a combination of mechanical tilting and electrical steering over a range of 0 to 20 degrees.

Alternatively, the array 300 may operable to reverse the directions of the tilting and corresponding steering (e.g., the tilt control system 324 is operable to tilt the array 300 downward, and an electrical steering control system is operable to electrically steer a main beam upward by an amount corresponding to the downward tilt of the array 300).

Referring to FIG. 3B there is depicted a distribution pattern of an antenna array that has been electrically steered downward by 2 degrees.

It will be understood that the above-described embodiments of the invention are illustrative in nature, and that modifications thereof may occur to those skilled in the art with the benefit of the teachings of this specification, without departing from the scope and spirit of the invention as described by the appended claims.

We claim:

1. An antenna array comprising:

a plurality of co-planar first antenna elements arranged in a planar sub-array, the planar sub-array configured to operate at a first power level; and at least one non-planar second antenna element configured to rotate relative to said planar sub-array, the at least one non-planar second antenna element configured to operate at a second power level, the second power level greater than the first power level.

2. The antenna array of claim 1, wherein the at least one non-planar antenna element is configured to rotate relative to said planar sub-array at an angle in the range of 10 to 70 degrees.

3. The antenna array of claim 1, wherein said sub-array is configured in a substantially vertical planar orientation to direct a radiated beam toward a horizon.

4. The antenna array of claim 1, wherein said sub-array comprises eight co-planar antenna elements.

5. The antenna array of claim 1, further comprising:

a power control section operable to supply a substantially same, first RF signal having the first power level to the planar sub-array, and supply a second RF signal having the second power level to the at least one non-planar second antenna element.

6. The antenna array of claim 1, wherein the second power level is six times more than the first power level.

7. The antenna array of claim 1, further comprising a tilt control system operable to rotate the at least one non-planar antenna element.

8. The antenna array of claim 1, further comprising an electrical steering control system operable to electrically steer a main beam downwards by an amount corresponding to the upwards tilt of the array.

9. The antenna array of claim 8, wherein the electrical steering control system is further operable to electrically steer the main beam over a range of 0-20 degrees.

10. The antenna array of claim 1, wherein said at least one non-planar second antenna element is configured to, while energized, fill in at least a portion of a top null in an emission pattern of the planar sub-array to support air-to-ground (ATG) communication.

11. The antenna array of claim 1, wherein the second power level is up to ten times greater than the first power level.

12. A method for configuring an antenna array comprising:

arranging a plurality of co-planar first antenna elements in a planar sub-array and configuring the planar sub-array to operate at a first power level; and configuring at least one non-planar antenna element to rotate relative to said planar sub-array and operate at a second power level greater than the first power level.

13. The method of claim 12, further comprising configuring the at least one non-planar second antenna element to rotate relative to said planar sub-array at an angle in the range of 10-70 degrees.

14. The method of claim 12, further comprising arranging the co-planar elements of the sub-array in a substantially vertical planar orientation to direct a radiated beam toward a horizon.

15. The method of claim 12, wherein said sub-array comprises eight co-planar antenna elements.

16. The method of claim 12 further comprising:

supplying a substantially same, first RF signal having the first power level to each antenna element of the planar sub-array, and supplying a second RF signal having the second power level to the at least one non-planar second antenna element.

17. The method of claim 12, wherein the second power level is six times more than the first power level.

18. The method of claim 12, wherein the second power level is up to ten times greater than the first power level.

* * * * *